US011019883B2

(12) United States Patent
Frydlewski et al.

(10) Patent No.: US 11,019,883 B2
(45) Date of Patent: Jun. 1, 2021

(54) FASTENING DEVICES AND METHODS

(71) Applicant: Hickies Inc., Brooklyn, NY (US)

(72) Inventors: Gaston Frydlewski, Brooklyn, NY (US); Maria R. Waingarten, Brooklyn, NY (US); David Reeb, Sykesville, MD (US)

(73) Assignee: HICKIES, INC., Brooklyn, NY (US)

( * ) Notice: Subject to any disclaimer, the term of this patent is extended or adjusted under 35 U.S.C. 154(b) by 22 days.

(21) Appl. No.: 15/363,806

(22) Filed: Nov. 29, 2016

(65) Prior Publication Data

US 2017/0231327 A1 Aug. 17, 2017

Related U.S. Application Data

(63) Continuation of application No. 14/493,108, filed on Sep. 22, 2014, now Pat. No. 9,538,802.
(Continued)

(51) Int. Cl.
*A43C 11/22* (2006.01)
*A43C 11/14* (2006.01)
(Continued)

(52) U.S. Cl.
CPC ..... *A43C 11/22* (2013.01); *A43B 1/0081* (2013.01); *A43C 11/006* (2013.01); *A43C 11/1493* (2013.01); *Y10T 24/45251* (2015.01)

(58) Field of Classification Search
CPC ..... A43C 11/006; A43C 11/1493; A43C 1/02; A43C 1/003; A43C 1/00; A43C 11/22;
(Continued)

(56) References Cited

U.S. PATENT DOCUMENTS 146,913 A 1/1874 Keith
315,819 A 4/1885 Naylon
(Continued)

FOREIGN PATENT DOCUMENTS

BE 481867 A 4/1948
BR 6900021 U 4/1991
(Continued)

OTHER PUBLICATIONS

Extended European Search Report dated Jun. 26, 2017 in European Patent Application No. 14845433.3.
(Continued)

*Primary Examiner* — Jack W Lavinder
(74) *Attorney, Agent, or Firm* — Venable LLP; Michele V. Frank

(57) ABSTRACT

A fastening device for connecting identified openings, including: an elongated main body member defining a longitudinal axis, the main body member having a first end portion and a second end portion at opposite ends of the longitudinal axis; first and second tip end members located at the first end portion and second end portion of the body, respectively, the first and second tip end members each adapted to fit through one of the identified openings; and a first deformable interference portion located between the main body member and the first tip end member, and a second deformable interference portion located between the main body and the second tip end member; where the first and second deformable interference portions are each normally located in a rest state where they define an outer dimension that prevents their passage through one of the identified openings. Other embodiments, features and methods are also described.

19 Claims, 16 Drawing Sheets

Related U.S. Application Data

(60) Provisional application No. 61/899,445, filed on Nov. 4, 2013, provisional application No. 61/884,840, filed on Sep. 30, 2013, provisional application No. 61/880,204, filed on Sep. 20, 2013.

(51) Int. Cl.
*A43B 1/00* (2006.01)
*A43C 11/00* (2006.01)

(58) Field of Classification Search
CPC ..... A43C 11/008; A43C 11/08; A43C 11/00; A43C 11/14; A43C 9/00; Y10T 24/45251; Y10T 24/1406; Y10T 24/141; Y10T 24/1498; Y10T 24/3726; Y10T 24/3729; B65D 63/109; B65D 63/12; B65D 63/18; B65D 63/1018; B65D 63/10; F16L 3/233
See application file for complete search history.

(56) References Cited

U.S. PATENT DOCUMENTS 342,800 A * 6/1886 Magoon ..... A01K 13/008 54/79.2
562,114 A 6/1896 Benford
565,884 A 8/1896 Emmons
672,506 A 4/1901 Godward
705,562 A 7/1902 Chipley
715,599 A 12/1902 Pitts
830,902 A 9/1906 Keller
976,826 A 11/1910 Obele
1,055,118 A 3/1913 Ziegllr
1,184,647 A 5/1916 Holloway
1,458,088 A 6/1923 Unnold
1,595,630 A 8/1926 Stockton
1,678,241 A 7/1928 Benz
1,685,489 A 9/1928 Jansen
D89,286 S 2/1933 Rosenthal
1,898,225 A 2/1933 Szabo
1,934,455 A 11/1933 Staude et al.
1,945,932 A 2/1934 Caley
1,966,135 A 7/1934 Reh
2,264,644 A 12/1941 Santangelo
2,289,225 A 7/1942 Tonai
2,438,143 A 3/1948 Brown
2,689,991 A 9/1954 Fedankiw et al.
D177,723 S 5/1956 Doherty
D179,614 S 1/1957 Shafer
2,861,311 A 11/1958 Kurland
2,871,537 A 2/1959 Hickerson
D194,177 S 12/1962 Swett
3,193,950 A 7/1965 Liou
3,382,546 A 5/1968 Palmay
3,522,635 A 8/1970 Nilsson
3,701,572 A 10/1972 Velasquez
3,731,350 A 5/1973 Diebold
4,112,988 A 9/1978 Nelson
4,144,621 A 3/1979 Green
4,296,515 A 10/1981 Hauser
4,486,965 A 12/1984 Friton
5,214,826 A 6/1993 Fortune
5,230,171 A 7/1993 Cardaropoli
5,239,732 A 8/1993 Steven
5,295,315 A 3/1994 Osawa et al.
D346,895 S * 5/1994 Martin ..... D2/978
5,388,315 A 2/1995 Jones
5,465,442 A 11/1995 Merser
5,537,763 A 7/1996 Donnadieu et al.
5,586,353 A 12/1996 Merser
5,639,244 A 6/1997 Stricklin
5,692,276 A 12/1997 Paxton
D393,411 S 4/1998 Crowe
5,737,811 A 4/1998 Rashid
5,746,500 A 5/1998 Chien
5,799,376 A 9/1998 Harsley
5,822,844 A 10/1998 Mento
D409,522 S 5/1999 Satterfield et al.
6,073,315 A 6/2000 Rasmussen
D432,946 S 10/2000 Gorelick
6,282,817 B1 9/2001 Curet
6,313,406 B1 11/2001 Gretz
6,401,304 B1 6/2002 Dossett
6,490,767 B2 12/2002 Haiduk
6,513,210 B1 2/2003 Gonzalez
6,634,063 B2 10/2003 Joseph
6,701,589 B1 3/2004 Kliewer
D488,374 S 4/2004 Hussaini et al.
D492,897 S 7/2004 Strange et al.
D495,130 S 8/2004 Sherman
D503,034 S 3/2005 Choi
6,973,744 B2 12/2005 Curet
D513,880 S 1/2006 Domotor et al.
D542,928 S 5/2007 Bauer
D543,833 S 6/2007 Folk et al.
D544,338 S 6/2007 Christensen et al.
7,404,583 B1 7/2008 Hassen
D579,764 S 11/2008 Kuhlmann
7,506,420 B2 3/2009 Frydlewski
D590,705 S 4/2009 Kuhlmann
D596,759 S 7/2009 Burke
D599,196 S 9/2009 Ruffin et al.
D614,855 S 5/2010 Inohara et al.
D615,385 S 5/2010 Arendt
D623,933 S 9/2010 Mallin et al.
7,825,337 B2 11/2010 Young, IV
D628,936 S 12/2010 Edelstein
D637,065 S 5/2011 Krietzman et al.
D637,066 S 5/2011 Krietzman et al.
7,954,204 B2 6/2011 Hammerslag et al.
D641,708 S 7/2011 Yamauchi
D662,987 S 7/2012 Ianke
8,261,416 B2 9/2012 Rothbaum et al.
D672,230 S 12/2012 Laverack et al.
D678,000 S 3/2013 Lee et al.
8,448,354 B2 5/2013 Talley
D686,909 S 7/2013 Frydlewski et al.
8,590,121 B1 11/2013 Patt, Jr. et al.
D698,232 S 1/2014 Weinberg
8,677,579 B2 3/2014 Talley
D705,442 S 5/2014 Tipton et al.
D714,044 S 9/2014 Lee
8,832,913 B2 9/2014 Kajiwara et al.
8,850,675 B2 10/2014 Frydlewski et al.
D716,645 S 11/2014 Frydlewski et al.
D719,338 S 12/2014 Lee
D719,339 S 12/2014 Lee
D719,340 S 12/2014 Lee
D719,341 S 12/2014 Lee
D720,126 S 12/2014 Goldman et al.
D724,935 S 3/2015 Warner
D729,054 S 5/2015 Chen
D734,605 S 7/2015 Van Der Pol
D736,514 S 8/2015 Lach
9,204,689 B2 12/2015 Gonzalez
D752,333 S 3/2016 Van Der Pol
9,382,051 B2 7/2016 Creato
D774,879 S 12/2016 Martinson
D776,990 S 1/2017 To
9,538,802 B2 1/2017 Frydlewski et al.
D786,055 S 5/2017 Sola et al.
D790,207 S 6/2017 Park
9,675,137 B2 6/2017 Wu
9,687,047 B1 6/2017 Talley
9,730,493 B2 8/2017 Teifer
D797,548 S 9/2017 Sola et al.
9,820,535 B2 11/2017 Frydlewski et al.
D812,365 S 3/2018 Talley
D819,433 S 6/2018 Frydlewski et al.
D819,954 S 6/2018 Thomas
10,010,138 B1 7/2018 Nicholson
10,165,831 B2 1/2019 Tsai et al.
10,334,909 B2 7/2019 Knez
D855,304 S 8/2019 Sakai

(56) References Cited

U.S. PATENT DOCUMENTS

| | | | |
|---|---|---|---|
| 2002/0178559 | A1 | 12/2002 | Hsu |
| 2003/0140459 | A1 | 7/2003 | Strange et al. |
| 2003/0221334 | A1 | 12/2003 | McFee |
| 2004/0139583 | A1 | 7/2004 | Wendle |
| 2005/0125964 | A1 | 6/2005 | Tate |
| 2005/0251967 | A1 | 11/2005 | McNeill |
| 2005/0268435 | A1 | 12/2005 | Moughelbay et al. |
| 2006/0053658 | A1 | 3/2006 | Voughlohn |
| 2006/0168785 | A1 | 8/2006 | Kraft et al. |
| 2006/0254089 | A1 | 11/2006 | Frydlewski |
| 2009/0229095 | A1 | 9/2009 | Valdez |
| 2009/0235494 | A1 | 9/2009 | Browne et al. |
| 2009/0242439 | A1 | 10/2009 | Talley |
| 2009/0260267 | A1 | 10/2009 | Evans |
| 2010/0293767 | A1 | 11/2010 | Talley |
| 2010/0325849 | A1 | 12/2010 | Clayton |
| 2011/0047822 | A1 | 3/2011 | Pape |
| 2011/0058902 | A1 | 3/2011 | Barbeau et al. |
| 2011/0131773 | A1 | 6/2011 | Hsieh |
| 2011/0271491 | A1 | 11/2011 | Clawson |
| 2012/0117819 | A1 | 5/2012 | Atamian |
| 2012/0117820 | A1 | 5/2012 | Atamian |
| 2012/0180268 | A1 | 7/2012 | Chen |
| 2012/0192385 | A1 | 8/2012 | Burdett et al. |
| 2013/0199020 | A1 | 8/2013 | Frydlewski et al. |
| 2013/0232734 | A1 | 9/2013 | Schein et al. |
| 2014/0047739 | A1 | 2/2014 | Senegal |
| 2014/0215777 | A1 | 8/2014 | Lee |
| 2015/0230558 | A1 | 8/2015 | Flores |
| 2015/0296925 | A1 | 10/2015 | Park |
| 2016/0081433 | A1 | 3/2016 | Choi |
| 2016/0143397 | A1 | 5/2016 | Alvarez |
| 2016/0143398 | A1 | 5/2016 | Kim |
| 2016/0325897 | A1 | 11/2016 | Kierstead |
| 2016/0338455 | A1 | 11/2016 | Chuan |
| 2016/0340093 | A1 | 11/2016 | Muller |
| 2017/0231327 | A1 | 8/2017 | Frydlewski et al. |
| 2017/0354203 | A1 | 12/2017 | Tavares |
| 2018/0020780 | A1 | 1/2018 | Frydlewski et al. |
| 2018/0140051 | A1 | 5/2018 | Jugeau |
| 2018/0255878 | A1 | 9/2018 | Harris |

FOREIGN PATENT DOCUMENTS

| | | | |
|---|---|---|---|
| CN | 1036129 | A | 10/1989 |
| CN | 3052239 | | 12/1996 |
| CN | 3055530 | | 3/1997 |
| CN | 3105681 | | 3/1999 |
| CN | 1833567 | A | 9/2006 |
| CN | 201139130 | Y | 10/2008 |
| CN | 301041762 | | 10/2009 |
| CN | 301257699 | | 6/2010 |
| CN | 301267166 | | 6/2010 |
| DE | 20 2012 012779 | U1 | 3/2014 |
| FR | 955507 | A | 1/1950 |
| FR | 958758 | A | 3/1950 |
| JP | D1409037 | | 3/2011 |
| KR | 30-0723746 | | 1/2014 |
| KR | 30-0723764 | | 1/2014 |
| KR | 30-0723771 | | 1/2014 |
| KR | 30-0727868 | | 2/2014 |
| NL | 002305581-0001 | | 10/2013 |
| WO | 2009141942 | A1 | 11/2009 |
| WO | WO-2013066004 | A1 | 5/2013 |
| WO | WO-2013/119268 | A1 | 8/2013 |
| WO | WO-2014/106974 | A1 | 7/2014 |
| WO | 2018/035553 | A1 | 3/2018 |

OTHER PUBLICATIONS

"Jazzy Sports Laces," https://www.youtube.com/watch?v=XzawtAlHzsw, Aug. 13, 2015.

"Koollaces Inc" http://www.koollaces.net/en/contents/index_3_1.php, Aug. 13, 2015.

"Shop", 2014, 2 pages, accessed from the internet on Oct. 14, 2014 at <http://laceout.com/shop/>.

"Slastics Video English," https://vimeo.com/124641229, Aug. 13, 2015.

"Strapz Team Spirit" http://so-mine.net/porkolio/strapz-team-spirit-3/, Aug. 13, 2015.

Amazon, <http://www.amazon.de/dp/B008EA8RHQ/ref=asc_df_B008EA8RHQ21?smid=AMD1KJ2RZKKOW&taq=ciao-jewelry-mp-21&linkCode=dfo&creative=22506&creativeASIN=B008EA8RHQ&childASIN=B008EE8RHQ>, retrieved Oct. 7, 2014.

Amazon, <http://www.amazon.de/Lizas-Lederarmband-geflochten-Kristallen-LIZA119/dp/BooKYW17VU/ref=sr_1_152?s=jewelry&ie=UTF8&qid=1412677656&sr=1-152>, retrieved Oct. 7, 2014.

Application for a Declaration of Invalidity of a Registered Community Design against Registered Community Design 002075341-0001, dated Oct. 7, 2014.

Bottega Veneta, <http://www.bottegaveneta.com/de/weiteres-leder-accessoire_cod463670620h.html>, retrieved Oct. 7, 2014.

Chinese Evaluation Report of Design Patent of Chinese Application Serial No. 201230369100.3 dated Nov. 27, 2013, 27 pages—Chinese; 7 pages—English.

EPC Appln. Serial No. 13153930.6 mailed Apr. 7, 2014, 4 pages—English.

Extended European Search Report issued in European Application No. 13153930.6 dated Apr. 7, 2014.

International Search Report and Written Opinion in PCT International Application No. PCT/US14/56824, dated Dec. 16, 2014.

International Search Report and Written Opinion issued in International Patent Application No. PCT/US2012/041713 dated Aug. 12, 2012.

Laceout, <http://www.laceout.com>, retrieved Feb. 12, 2015.

Mr. Lacy, <http://mr-lacy.com>, retrieved Feb. 12, 2015.

Notice of Allowance issued in U.S. Appl. No. 13/367,362 dated Aug. 7, 2014.

Notice of Allowance issued in U.S. Appl. No. 29/412,658 dated May 21, 2013.

Notice of Allowance issued in U.S. Appl. No. 29/468,991 dated Sep. 2, 2014.

Notice of Allowance issued in U.S. Appl. No. 29/468,997 dated Sep. 25, 2014.

Notice of Allowance issued in U.S. Appl. No. 29/468,999 dated Sep. 9, 2014.

Office Action issued in Canadian Patent Application No. 2,831,406 dated Nov. 13, 2013.

Office Action issued in Chinese Patent Application No. 201210308271.4 dated Oct. 10, 2014.

Office Action issued in Chinese Patent Application No. 201280069064.6 dated Jul. 24, 2015.

Office Action issued in Chinese Patent Application No. 2012810308271.4, dated Aug. 25, 2015.

Office Action issued in Chinese Patent Application No. 23162378 dated Dec. 3, 2013.

Office Action issued in Colombian Patent Application No. 14-1713751 dated Jul. 7, 2015.

Office Action issued in Korean Patent Application No. 102300429 dated Aug. 8, 2013.

Office Action issued in Design U.S. Appl. No. 29/468,543 dated Jun. 16, 2015.

Office Action issued in U.S. Appl. No. 13/367,362 dated Apr. 16, 2014.

Office Action issued in U.S. Appl. No. 14/493,108 dated Apr. 16, 2015.

Office Action issued in U.S. Appl. No. 14/493,108 dated Dec. 11, 2015.

Office Action issued in U.S. Appl. No. 14/493,108 dated Mar. 18, 2016.

Search Report issued in Korean Patent Application No. 102300429 dated Jul. 18, 2013.

Substantive Examination Report issued in Philippines Patent Application No. 1/2014/501752 dated Mar. 17, 2015.

U-Laces, <http://www.u-lace.com>, retrieved Feb. 12, 2015.

(56) References Cited

OTHER PUBLICATIONS

UX Movement, "Why Rounded Corners are Easier on the Eyes", <http://uxmovement.com/thinking/why-rounded-corners-are-easier-on-the-eyes/>, retrieved on Feb. 12, 2015.
Yankz, <http://www.yankz.com>, retrieved Feb. 12, 2015.
Examination Report issued in Malaysia Patent Application No. PI 2014002296, dated Jan. 15, 2018.
Notice of Allowance dated Mar. 13, 2017 in Design U.S. Appl. No. 29/561,464.
Koollaces Silicone https://www.youtube.com/watch?v=D9oLmKHcV_4 Mar. 5, 2013.
Koollaces Koollaces_Hook https://www.youtube.com/watch?v=l21iX8OexkU Mar. 10, 2013.
Koollaces Vldeo with subtitlesHow to use for Koollaces https://www.youtube.com/watch?v=ab0CubhtOrs May 26, 2013.
Koollaces [Koollaces] How to use "Hook type" shoelaces https://www.youtube.com/watch?v=cZoh5_tOy9E Jul. 28, 2013.
Non-Final Office Action in corresponding U.S. Appl. No. 15/678,712 dated Jun. 5, 2019 (7 pages).
Final Office Action in corresponding U.S. Appl. No. 15/678,712 dated Oct. 17, 2019 (6 pages).
Non-Final Office Action in corresponding U.S. Appl. No. 15/678,712 dated Feb. 27, 2020 (6 pages).
Notice of Allowance in corresponding U.S. Appl. No. 15/678,712 dated Aug. 20, 2020 (5 pages).
Notice of Allowance in corresponding U.S. Appl. No. 15/678,712 dated Dec. 3, 2020 (6 pages).
Extended European Search Report in corresponding European Application No. 19160726.6 dated May 21, 2019 (8 pages).
European Office Action in corresponding European Application No. 19160726.6 dated Feb. 17, 2020 (5 pages).
European Office Action in corresponding European Application No. 20188090.3 dated Sep. 9, 2020 (5 pages).
European Office Action in corresponding European Application No. 14845433.3 dated Jan. 23, 2017 (8 pages).
European Office Action in corresponding European Application No. 14845433.3 dated Mar. 22, 2018 (5 pages).
Indian Office Action in corresponding Indian Patent Application No. 1628/KOLNP/2014 dated Aug. 28, 2018 (7 pages).
Indian Notice of Hearing in corresponding Indian Patent Application No. 1628/KOLNP/2014 dated Sep. 21, 2020 (2 pages).
Panamanian Office Action in corresponding Panamanian Patent Application No. 90316-01 dated Mar. 14, 2017 (7 pages).
Chilean Office Action in corresponding Chilean Patent Application No. 201402085 dated Jan. 10, 2017 (3 pages).

* cited by examiner

FASTENING DEVICES AND METHODS

CROSS REFERENCE TO RELATED APPLICATIONS

This application is a continuation of U.S. application Ser. No. 14/493,108 filed Sep. 22, 2014, which claims priority to the following patent applications: U.S. Application No. 61/880,204 filed Sep. 20, 2013; U.S. Application No. 61/884,840 filed Sep. 30, 2013; and U.S. Application No. 61/899,445 filed Nov. 4, 2013. The entire contents of each of the foregoing applications is incorporated herein by reference.

The entire contents of each of the following applications is incorporated herein by reference: U.S. application Ser. No. 29/412,658 filed Feb. 6, 2012, issued as D686,909 on Jul. 30, 2013; U.S. application Ser. No. 29/468,991 filed Oct. 4, 2013; U.S. application Ser. No. 29/468,997 filed Oct. 4, 2013; U.S. application Ser. No. 29/468,999 filed Oct. 4, 2013; U.S. application Ser. No. 13/367,362 filed Feb. 6, 2012; and PCT International Application No. PCT/US2012/041713 filed Jun. 8, 2012.

TECHNICAL FIELD

The present invention relates generally to fastening devices and systems using the fastening devices. More particularly, the present invention provides fastening devices that secure opposing sides of an article selected for securing allowing secure engagement and reliability against unintended separation and breakage.

BACKGROUND

Industrial applications of fastening devices include the use of thread or string, including shoe laces. Unfortunately, during use, particularly during rough sports play or hard work activities, these conventional fastening devices are often broken, shred, or become unreliable, or even dangerous to users.

Accordingly, there is a need for an improved fastening device that provides an improved reliability and use. Further, there is also a need to improve a method of using a fastening device where the installation and application of a fastening device allows an adaptive use to a variety of alternative engagements with articles requiring fastening.

SUMMARY

In response, it is now recognized that there is a need for a higher performance fastening system that adapts to a user's needs and is durable and tough in use.

In one embodiment, a fastening device for connecting two identified openings can include an elongated main body member defining a longitudinal axis, the main body member having a first end portion and a second end portion at opposite ends of the longitudinal axis; first and second tip end members located at the first end portion and second end portion of the body, respectively, the first and second tip end members each adapted to fit through one of the identified openings; and a first deformable interference portion located between the main body member and the first tip end member, and a second deformable interference portion located between the main body and the second tip end member. In this embodiment, the first and second deformable interference portions are each normally located in a rest state wherein the first and second deformable interference portions define an outer dimension that prevents their passage through one of the identified openings, and the first and second deformable interference portions are each deformable to a stretched state that permits their passage through one of the identified openings.

In another embodiment, a fastening device for connecting two identified openings can include an elongated main body member defining a longitudinal axis, the main body member having a first end portion and a second end portion at opposite ends of the longitudinal axis; and a first tip end portion located at the first end portion of the main body member and a second tip end portion located at the second end portion of the main body member, the first and second tip end portions each having an outer dimension configured to pass through one of the identified openings. In this embodiment, in a relaxed state, the first and second tip end portions extend substantially orthogonal to the longitudinal axis, and wherein the first and second tip end portions are each elastically pivotable with respect to the main body member about the longitudinal axis to permit passage of the respective tip end portion through one of the identified openings.

In another embodiment, a method for connecting two identified openings can include: providing a fastening device including an elongated main body member defining a longitudinal axis, and first and second tip end members located at opposite ends of the longitudinal axis; inserting the first tip end member through one of the identified openings; pulling on the first tip end member, thereby pulling a first deformable interference portion through the one of the identified openings; inserting the second tip end member through the other of the identified openings; and pulling on the second tip end member, thereby pulling a second deformable interference portion through the other of the identified openings; whereby the first and second deformable interference portions retain the fastening device in the two identified openings.

In another embodiment, a method of connecting two identified openings can include: providing a fastening device including an elongated main body member defining a longitudinal axis, and first and second tip end portions located at opposite ends of the longitudinal axis, the first and second tip end portions extending substantially orthogonal to the longitudinal axis; inserting the first tip end portion through one of the identified openings; flexing the first tip end portion with respect to the main body member, thereby permitting passage of the first tip end portion through the one of the identified openings; relaxing the first tip end portion; inserting the second tip end portion through the other of the identified openings; flexing the second tip end portion with respect to the main body member, thereby permitting passage of the second tip end portion through the other of the identified openings; and relaxing the second tip end portion; whereby when the first and second tip end portions are in the relaxed state, they engage the two identified openings with the main body member between the two identified openings.

The above and other aspects, features and advantages of the present invention will become apparent from the following description read in conjunction with the accompanying drawings, in which like reference numerals designate the same elements.

DETAILED DESCRIPTION

Figure 1:
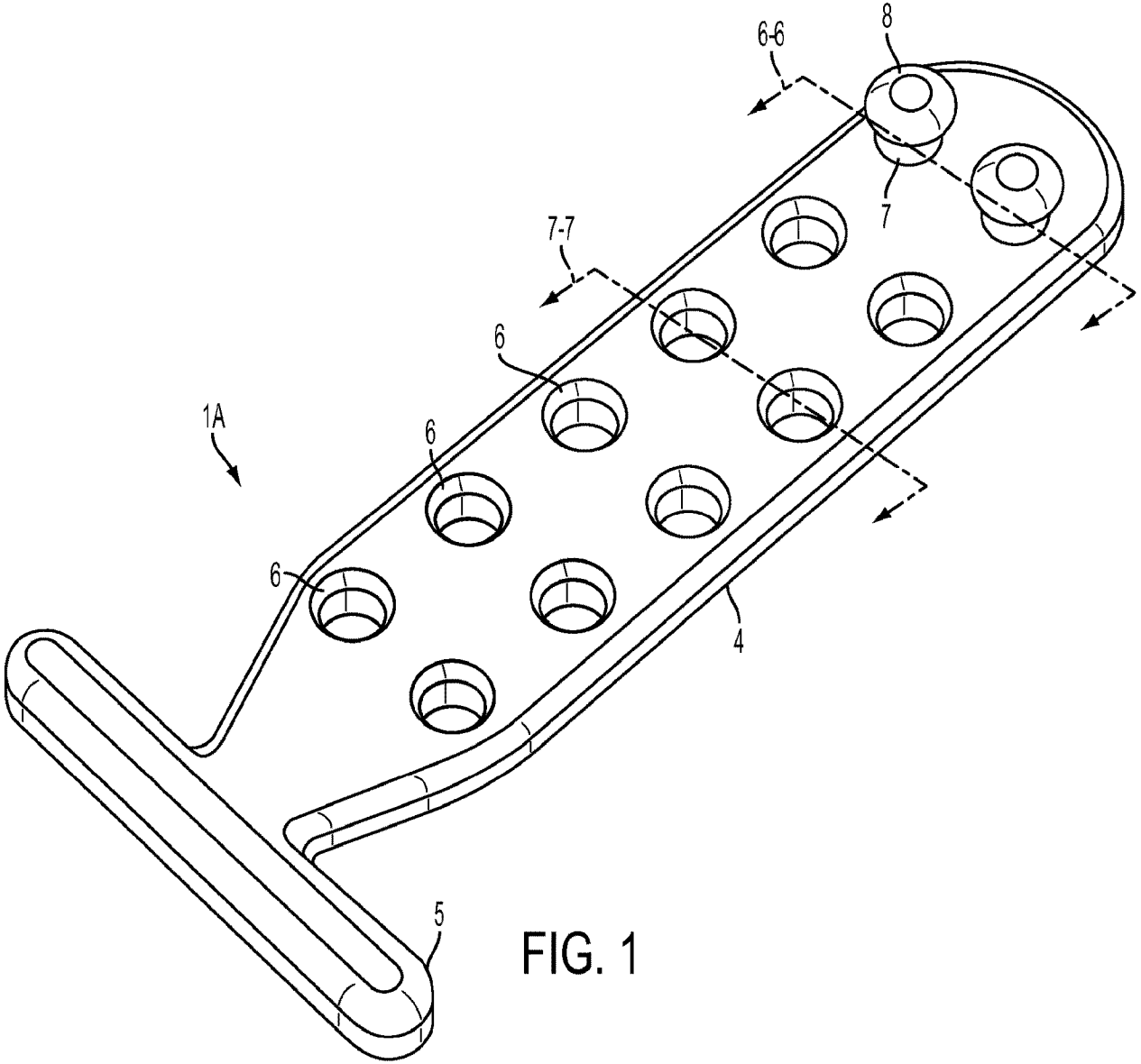
FIG. 1 is a perspective view of a single fastening device according to an aspect of the present invention.
Figure 2:
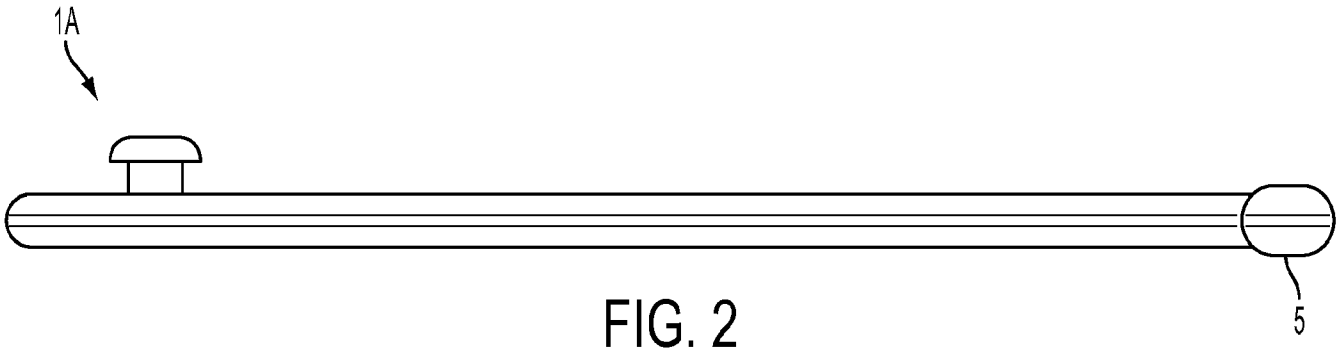
FIG. 2 is a side elevation view of FIG. 1.
Figure 3:
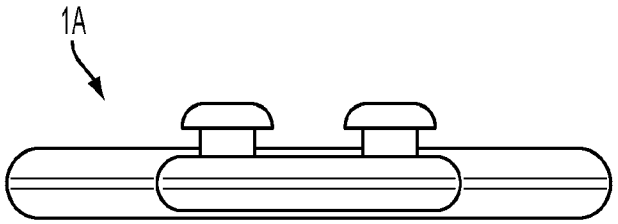
FIG. 3 is a side elevation view of FIG. 1.
Figure 4:
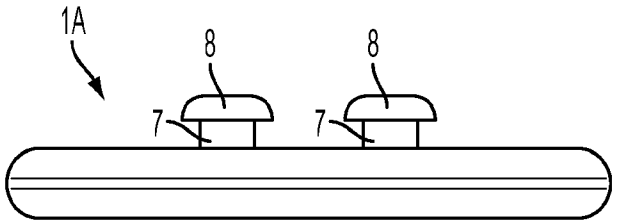
FIG. 4 is another side elevation view of FIG. 1.
Figure 5:
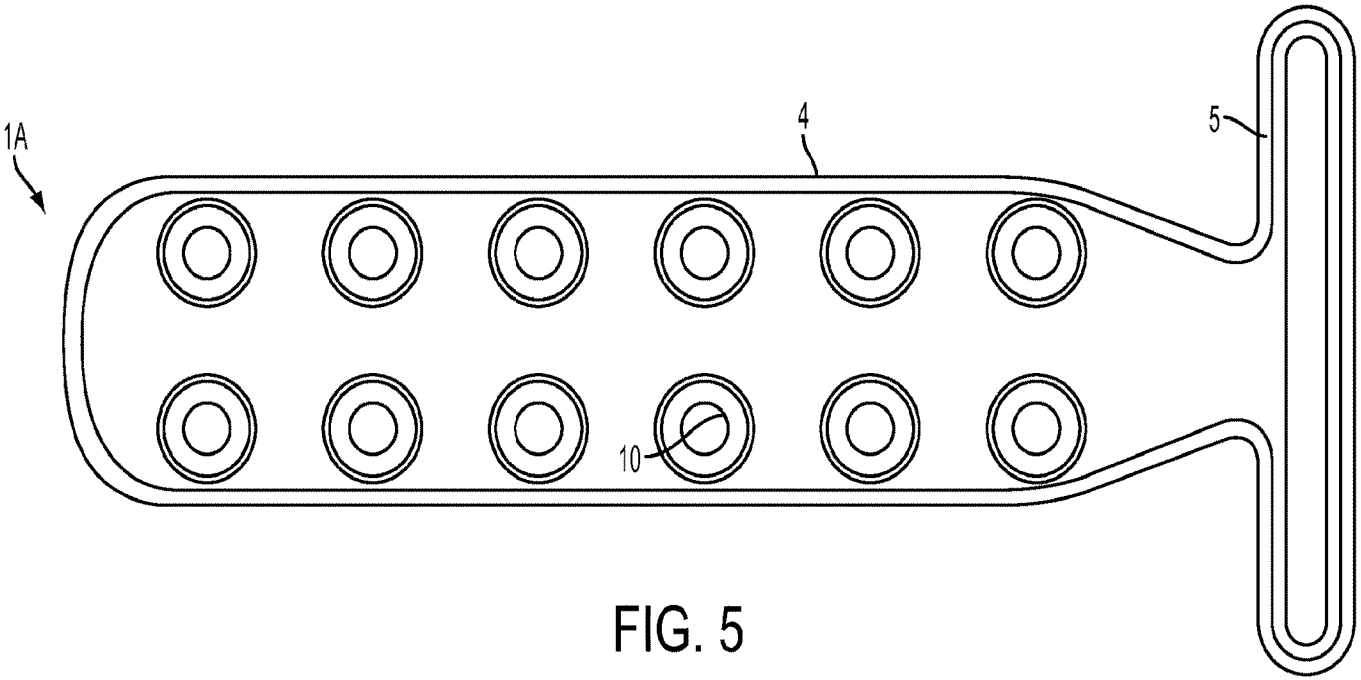
FIG. 5 is a top view of FIG. 1 noting the position of alternative openings and pin members.
Figure 7:
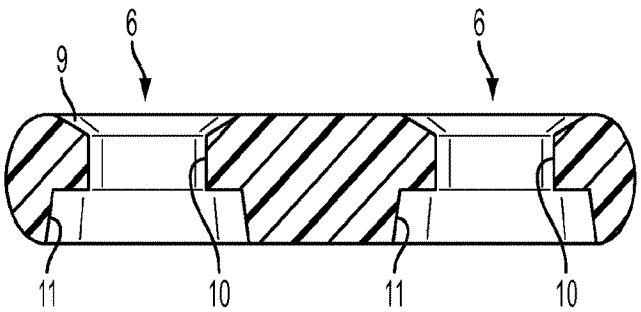
FIG. 7 is a cross section along Section 7-7 in FIG. 1.
Figure 6:
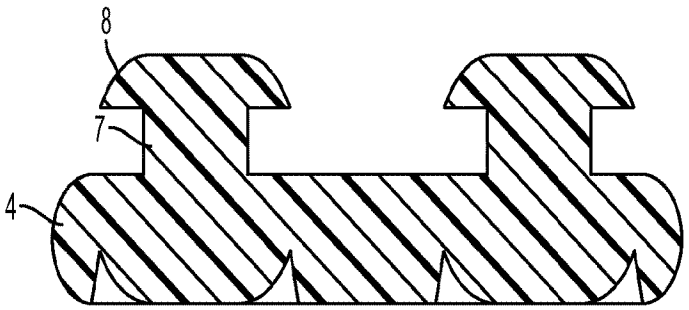
FIG. 6 is a cross section along Section 6-6 in FIG. 1.
Figure 8:
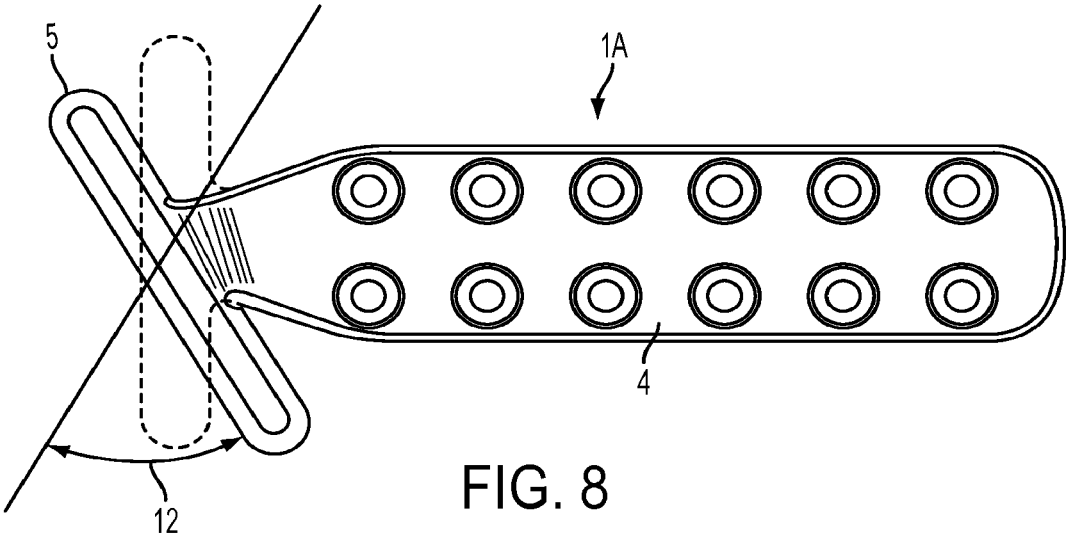
FIG. 8 is a view of the fastening device in FIG. 1 noting the flexibility of the neck region allowing the tip end portion to rotate relative to a long axis direction of a main body.
Figure 9:
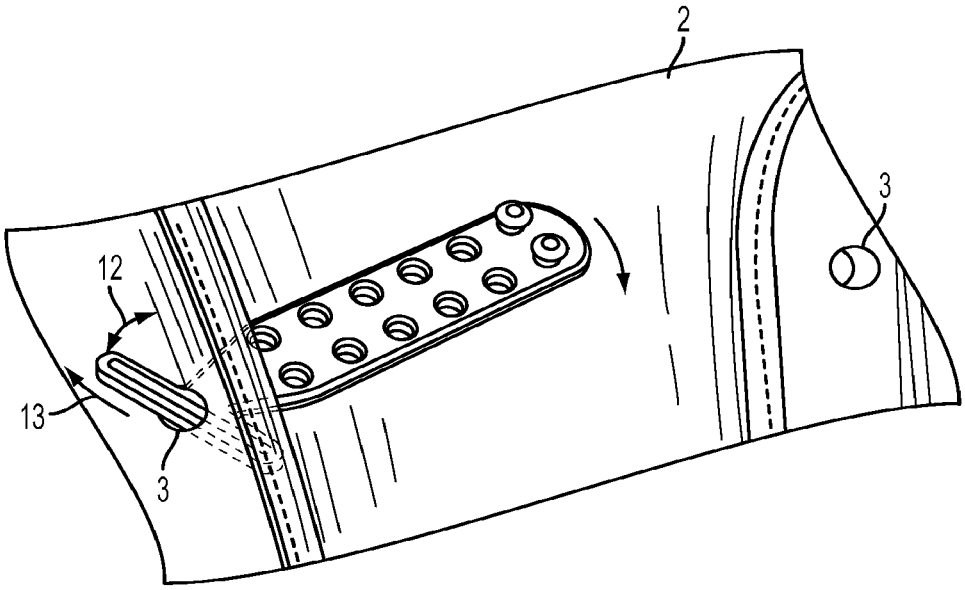
FIG. 9 is a perspective use view wherein the tip end portion is pushed partially through an eyelet opening of an exemplary sneaker member in a first assembly step.

Reference will now be made in detail to embodiments of the invention. Wherever possible, same or similar reference numerals are used in the drawings and the description to refer to the same or like parts or steps. The drawings are in simplified form and are not to precise scale. The word "couple," "interfit," "connect" and similar terms do not necessarily denote direct and immediate connections, but also include connections through intermediate elements or devices. For purposes of convenience and clarity only, directional (up/down, etc.) or motional (forward/back, bend/fold, push/pull, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Referring now to FIGS. 1 through 15, a fastening system 100 may include a first and a second fastening device, respectively, shown at 1A and 1B. Each fastening device 1A, 1B includes a tip end portion 5 and a main body portion 6, which may adaptively be used to secure respective eyelet openings (identified openings) 3 of a shoe 2 therebetween. (See e.g., FIGS. 14 and 15.)

Each main body 4 can include a plurality of operative openings 6 and at least one pin member 7, preferably having a respective tail 8. It is noted that for openings 6 and pin members 7, tails 8 have cooperative interference fitting geometry, including respective sizes. Tails 8 may be excluded, or pin members 7 and tails 8 may be formed in different shapes, as well as openings 6 wherein the interfitting geometry may be enhanced. For a non-limiting example, tails 8 are shown as larger in outer dimension than pins 7 so that, following passage through an opening 6, the outer surfaces of tails 8 may positively contact formed inner flat surfaces of openings 6 in a manner preventing easy disassembly under stress and tension. According to alternative embodiments, the components 1A and 1B can be a single monolithic member.

It will be understood, that holes 6 and pins 7, and tails 8 may be formed in a generally circular manner (as shown) but that there is no restriction thereto. For example, hole 6 may be triangular, as may pin 7 while tails 8 may remain semi-circular. In this way, it will be understood that geometric interference fitting may use adaptive and alternative geometries without departing from the scope and spirit of the present invention.

In this way it will be understood that openings 6 can include, optionally, a central passage 10 having the same diameter as pins 7, and a sloped or angled opening 9 with sloped side walls to ease insertion of tails 8, and a secure wall 11 arrangement, shown here with a flat surface for parallel engagement with the underside surface of tails 8. In this way the openings 6 and pins 7 provide an interoperability and secure interference fitting to secure respective fastening devices 1A, 1B together.

Figure 10:
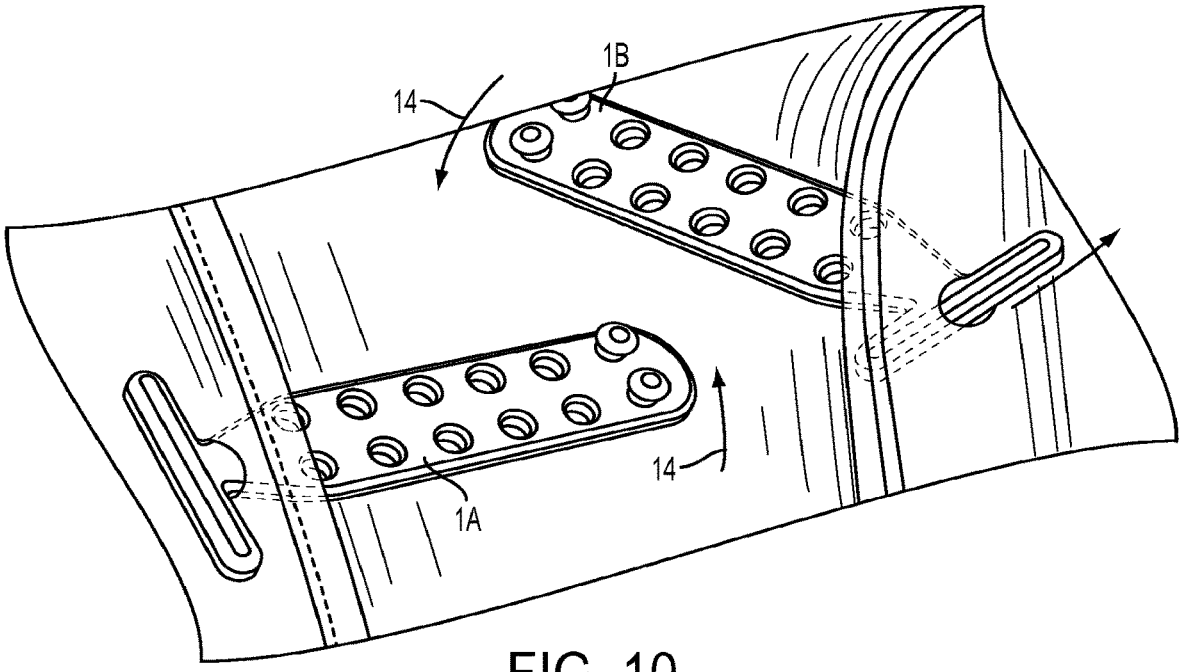
FIG. 10 is a perspective use view wherein the tip end of a first fastening device is positioned through an eyelet and awaiting interfit connection with a second fastening device partially through an opposing eyelet.
Figure 11:
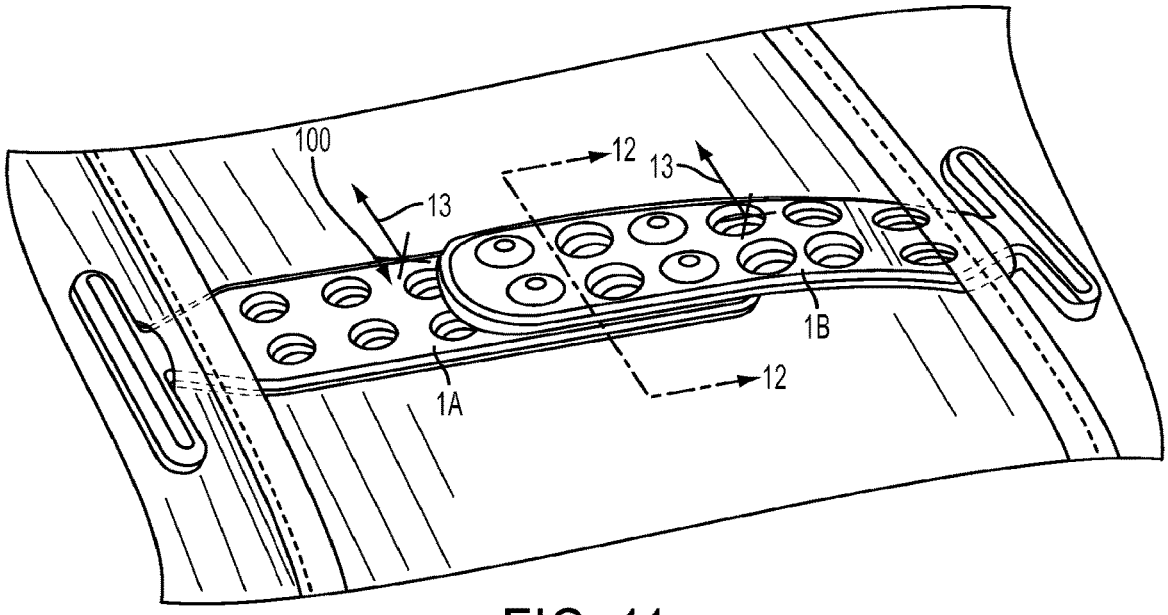
FIG. 11 is a perspective view of a fastening system in position during a use wherein pins and openings are adjustably positionable along the length of respective fastening devices.

Referring now specifically to FIGS. 8 to 15, two alternative methods of use can be provided. A first method in FIGS. 8-11 shows the use of the tip end entering eyelet opening 3 by initially tilting relative to the main body 4 an angle 12 allowed by the flexible neck portion between main body 4 and tip end 5. Tip end 5 may be pushed or pulled through eyelet opening 3 and is operably sufficiently flexible to accommodate this embodiment. The same procedure is provided on the other side of the shoe. As a result, the interfitting shown in FIGS. 10 and 11 is provided by swinging and urging together 14 for pins 7, and tails 8 are pushed through and into openings 6. During use, and to fit a user's preference, the main bodies may be separated, realigned, and re-connected.

Figure 12:
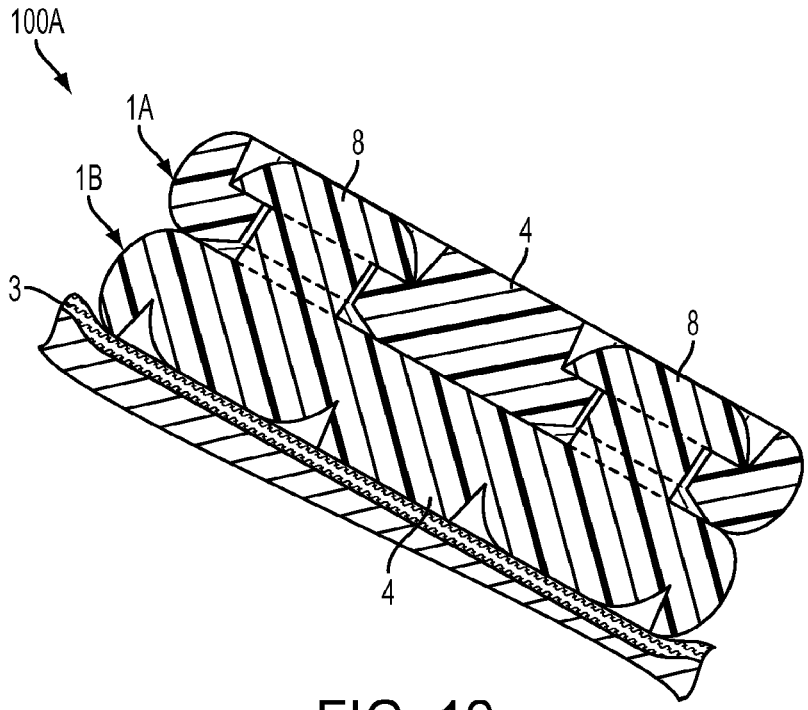
FIG. 12 is a cross section along Section 12-12 in FIG. 11.
Figure 13:
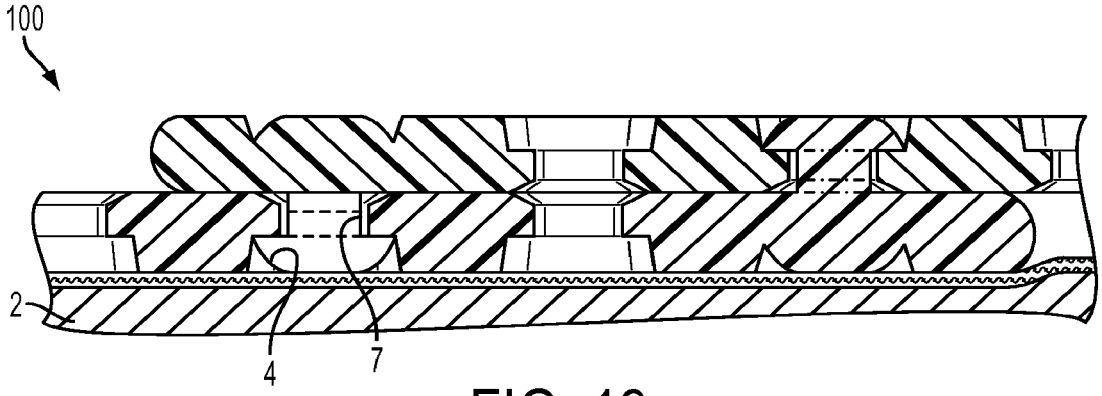
FIG. 13 is a cross section along Section 13-13 in FIG. 11.
Figure 14:
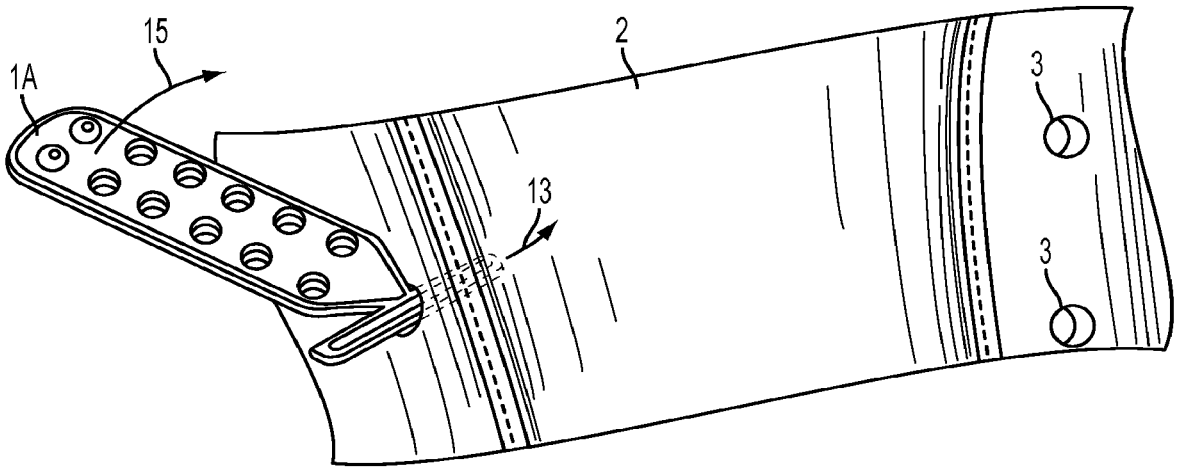
FIG. 14 is an alternative insertion method step from an opposite side of an eyelet opening.
Figure 15:
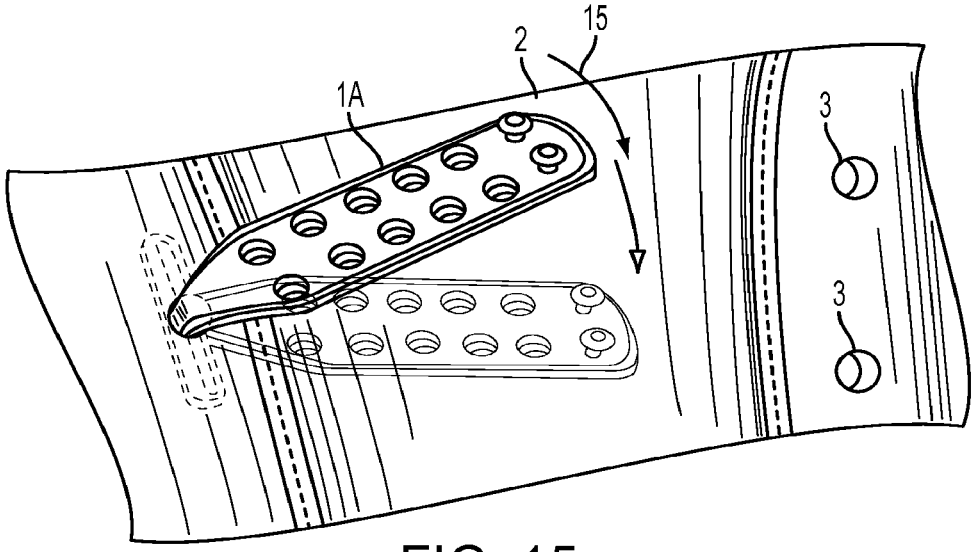
FIG. 15 is a further method step of positioning and then folding over a fastening device in preparation of meeting with a corresponding fastening device for engaging interfit therewith forming one optional fastening system.
Figure 16:
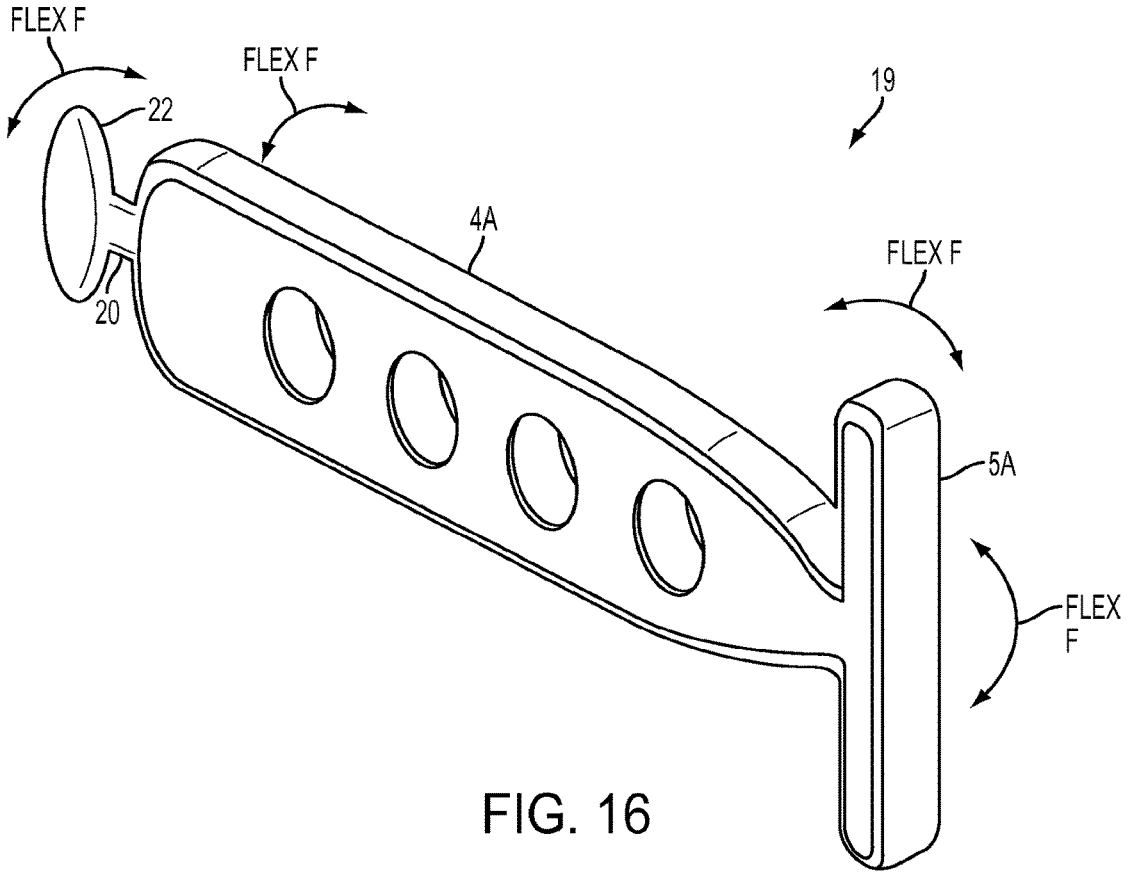
FIG. 16 is a perspective view of an alternative embodiment of the present invention providing an extending toggle system on an adapted fastening system.
Figure 17:
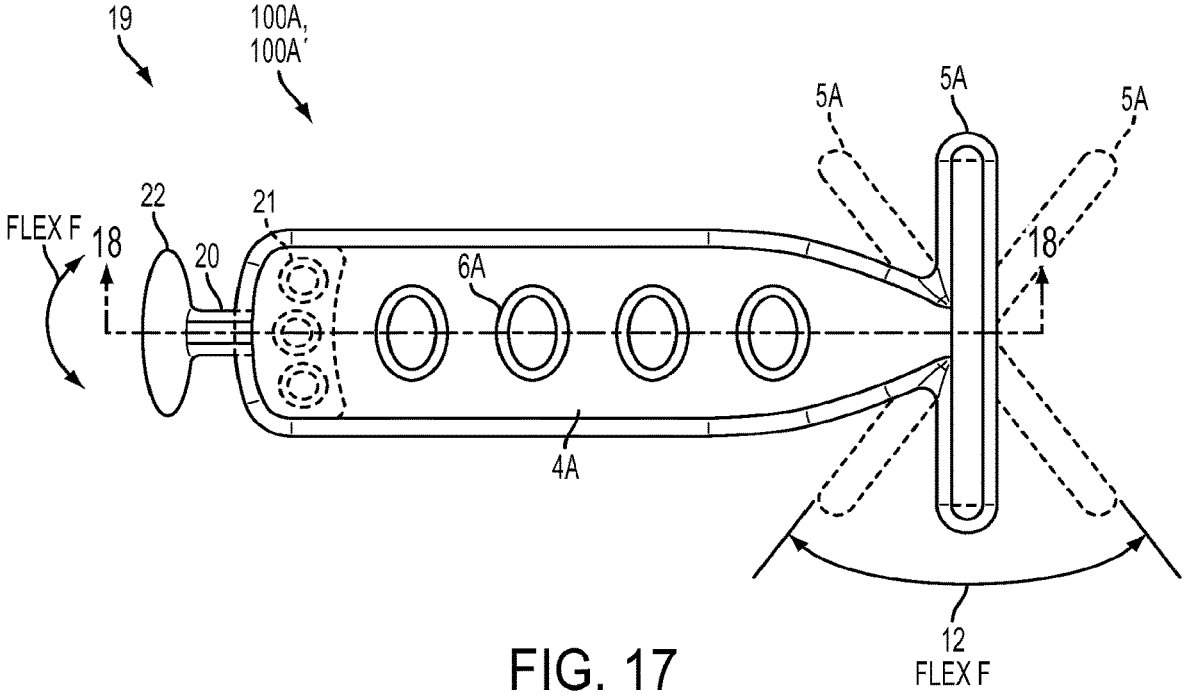
FIG. 17 is a front elevation plan view of FIG. 16 noting the main body and opposing toggle system and tip end.

Referring now particularly to FIGS. 14 and 15, an alternative method is provided. Here, tip ends 5 are pushed from the outward side of eyelet openings 3 toward the inner side, and then pivoted along bend 15 to reach the center region of shoe 2. When completed from both sides, the fastening devices 1A and 1B will be aligned as shown in FIGS. 12, 13 and interfitted. It will be noted that the neck region between tip end 5 and main body 4 is sufficiently flexible to accommodate this operation.

It will be understood that the fastening system 100 and the respective fastening devices 1 A, 1 B may be alternatively referred to as means for fastening or fastening means, without departing from the scope of the present invention.

It will be further understood, that the present fastening system 100 may be shown with two-rows of openings 6, but may alternatively be shown with only a single-row of openings 6 e.g., a narrower main body 4. It will be also understood that either one or both of the main body 4 and tip end 5 may be formed of silicone, a resilient material, or may additionally include a stiffening member therein. For example, the tip end 5 may be stiffened with a molded pin located therein. This may help with the insertion of the tip end 5 through the eyelet openings 3 and/or aid the rotation of tip end 5 relative to main body 4. It will also be understood that the main body 4 may be made with any type of opening and pin geometry without departing from the scope and spirit of the present invention. It will also be understood that components 1A and 1B can be found as a unitary, monolithic component.

Referring now to FIGS. 16-23, a fastening device is provided as two adaptively engageable alternative fastening systems 100A, 100A' each with an opposing tip end 5A from a toggle system 19 spaced by a flexible main body portion 4A with a plurality of engaging regions 6A, shown here but not limited to, openings. While regions 6A are shown as ovoidal, circular, or irregular openings, nothing herein is so limiting, and main body portion 4A may be provided with any geometric engagement portion suitable for engaging respective toggle system 19 portions during a use. For example, extending grippers (not shown) may engage opposite sides of toggle 22 extending from a toggle neck 20 from an embedded toggle anchor system 21 integrally formed with main body 4A, respectively.

Toggle anchor system 19 can include a toggle neck 20 spacing, a toggle anchor system 21, shown molded into main body 4A, and an opposed tip end 5A, as shown.

Toggle anchor system 21 may be in any convenient shape sufficient to secure flexible toggle neck 20 to main body 4A and to allow a flexibility F during a use thereof. It is envisioned, but not required, that toggle anchor system 21 be co-molded with flexible main body 4A, but may alternatively be secured thereto in a non-removable manner without departing from the scope and spirit of the present invention.

As noted with the earlier embodiment, tip end 5A may be flexible F to allow interfitting as noted in FIGS. 14 and 15 discussed earlier. In this manner, during a use, respective fastening systems 100A, 100A' allow flexible engagement of opposed eyelet openings 3, 3 of shoe 2, such that all earlier discussion of such flexibility is additionally incorporated herein by reference for convenience. According to alternative embodiments, components 100A, 100A' can comprise a single, unitary component.

Figure 18:
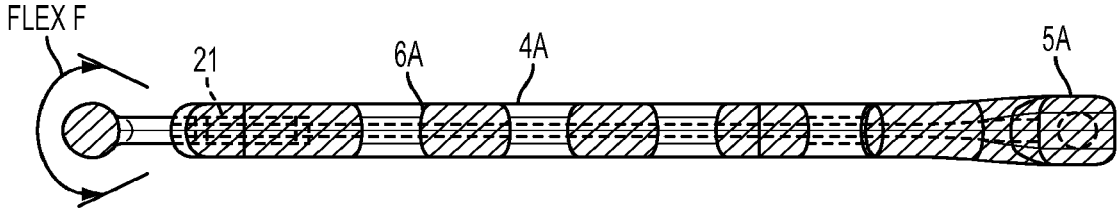
FIG. 18 is a section view along section line 18-18 in FIG. 16.
Figure 19:
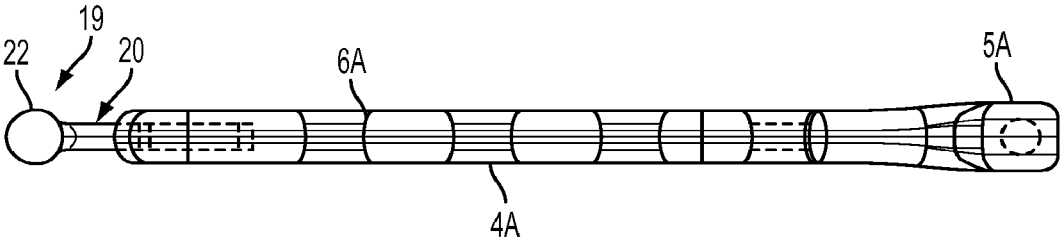
FIG. 19 is a top plan view of FIG. 16 noting the extension of the opposed toggle system and tip end.
Figure 20:
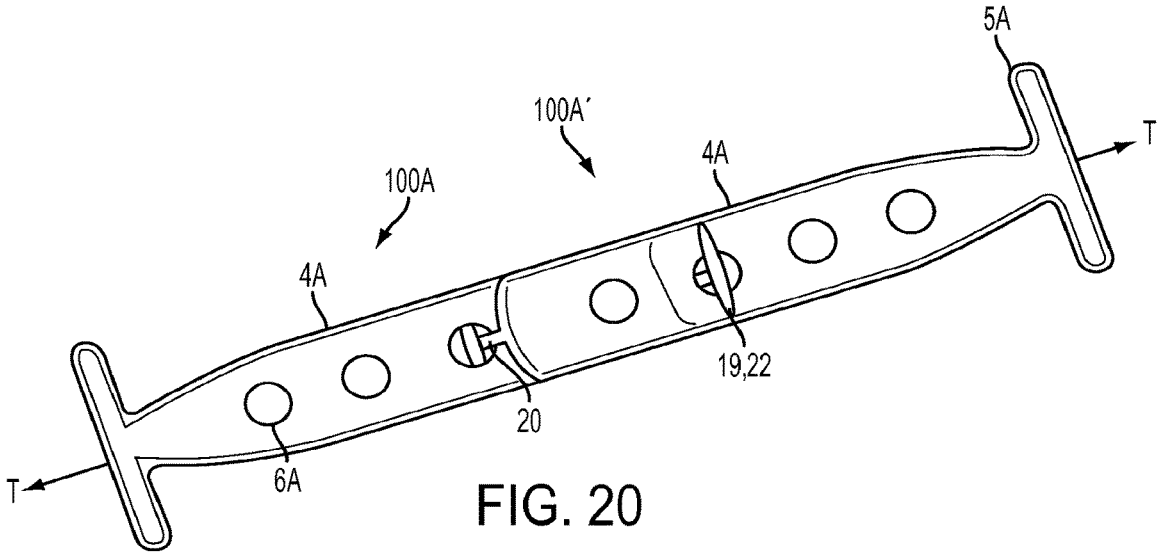
FIG. 20 is a top slight-perspective view of two interconnected but removably positionable fastening systems as in FIG. 16, wherein the interconnected system is shown under tension "T" from opposing tip ends where the interconnected fastening systems flex under tension to securely engage therebetween.
Figure 21:
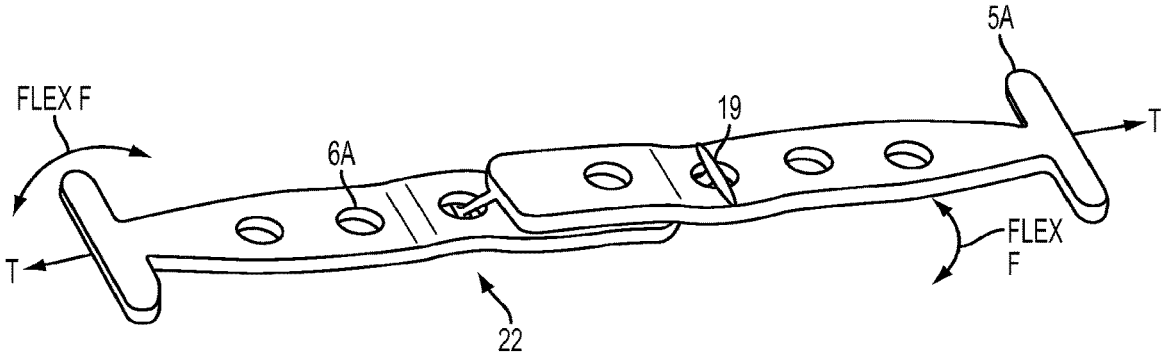
FIG. 21 is a perspective view as in FIG. 20, noting the flex in the main body and toggle necks during interengagement tension.
Figure 22:
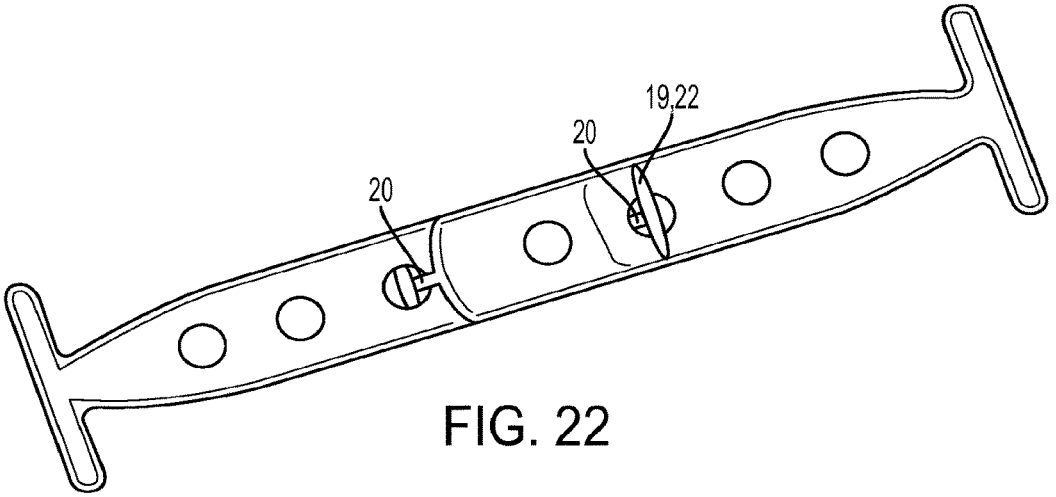
FIG. 22 is a further view similar to FIG. 20 noting the flex during engagement.

As noted in FIGS. 18 and 19, openings 6A penetrate flexible main body 4A, in a preferably ovoidal manner so that under tension T (FIG. 20), openings flex in to a narrower (from the width direction) dimension to engage and secure toggle neck portions 20 to prevent unintended removal thereof.

During a use, as for example in replacing the images in FIGS. 14 and 15, toggle systems 19 engage with respective openings 6A of main bodies 4A and may be adjusted to fit in any opening. Thus, during use under tension T, there is a best-fit flexing well shown in FIG. 21, where there is a slight flexing of main bodies 4A, 4A to accommodate the tension T thereby and to also flex respective toggle necks 20 and thereby secure respective fastening systems 100A, 100A'.

It will additionally be understood, that any suitable material to perform the functions herein may be used, without limitation thereto. For example, the toggle system 19 may be thermoplastic, high density or mid-density plastic (all flexible), rigid metal, wood, or any other suitable material for such a toggle. Additionally, the tip end 5A may be reinforced with an internal rigid member that may be slightly flexible (e.g., HDPE, etc.) or fully rigid (e.g., metal, plastic etc.).

As mentioned before, embodiments can comprise an elongated unitary or one-piece body having respective first and second ends. Each end can terminate in a tip portion which has a cross-section that permits the tip to be inserted through the eyelet for which it is intended. The tip can be of a length suitable for grasping with the fingers. According to an embodiment, interposed between, and connecting the tip portion and the elongate body can be a resilient, deformable region that circumscribes and defines an opening. The deformable region may have a circular shape and define a substantially circular opening, but according to embodiments, it is arc-shaped and defines an arc-shaped opening. The convex side of the arc can be oriented toward the body, while the concave side can be oriented toward the tip portion.

In use, the tip may be inserted through an eyelet, and then grasped and pulled so as to apply tension substantially along the long axis of the device. This tension can cause the deformable region, and the opening it defines, to stretch along the long axis of the device. The tension and resulting deformation can cause the sides of the deformable region to move toward the axis, reducing the effective cross-section of the deformable region until it can pass through the eyelet. Upon release of the tension, the deformable region rebounds to its relaxed state, in which it no longer can fit through the eyelet. The process is repeated with the second end portion of the device, by pulling it through a second eyelet of the article to be fastened, or through an eyelet of a second article which the practitioner wishes to attach to the first article.

The fastening tension provided by an installed device of the invention is borne by the central body of the device. At the eyelets, this tension is created by an outward-directed force applied axially to the deformable regions, at the point where contact is made with the surface of the article immediately surrounding the eyelets. According to embodiments, this outward force does not cause a reduction in cross-section of the deformable region, however, and the device resists being pulled through the eyelet. In embodiments, where the deformable region and the opening it defines are arc-shaped, the deformable region can be particularly resistant to compression because the inner portion of the arc, adjacent to the tip, is situated within the radius of the outer portion of the arc, where it physically blocks the deformation required for a reduction in cross-section. Although resistant to being pulled through the eyelet in the inward direction, the device can readily be removed by pulling on the tip in the outward direction, thereby reversing the installation process.

For ease and economics of manufacture, embodiments of the invention can be molded from a single elastomeric material. Suitable materials include, but are not limited to, synthetic rubbers, silicone rubbers and polyurethanes. In devices having such monolithic construction, the desired amount of stretch or rigidity in any particular portion of the device will be obtained by varying the thickness of that portion. In alternative embodiments, strengthening or stiffening elements may be inserted, laminated, or molded into the elastomer. Such elements include, but are not limited to, monofilament, spun, or woven fiber reinforcement materials, rigid or semi-rigid inserts, and elastomeric inserts or layers having a different modulus and/or elasticity. The devices may also be formed directly from two or more different materials, for example by bi-injection or two-shot injection molding, so as to have the desired distribution of physical properties along the length of the device. Embodiments may be made by 3D printing or additive manufacturing.

Figure 23:
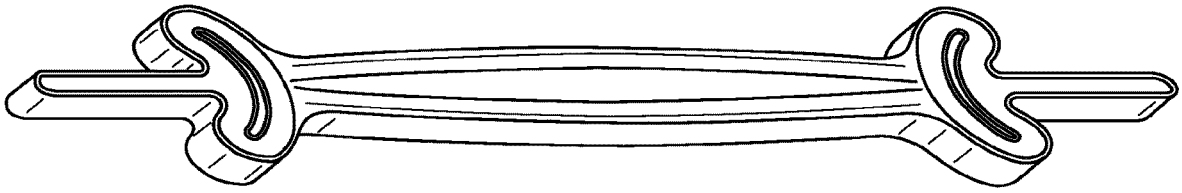
FIG. 23 is a perspective view of a fastening device according to an embodiment of the present invention.

Referring now to FIG. 23, a perspective view of one embodiment of the invention is provided without numbering, to clearly convey the overall appearance of the device.

Figure 24:
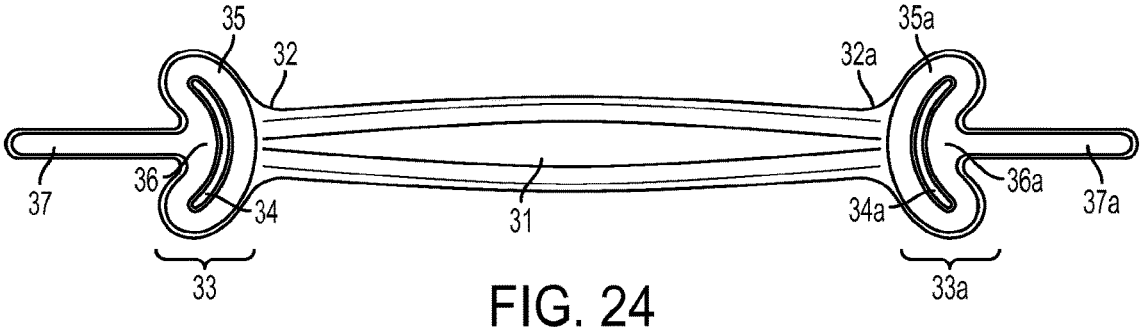
FIG. 24 is a top view of the device shown in FIG. 23.

FIG. 24 is a top view of the same device. The device includes an elongated central body 31, which terminates at necks 32 and 32*a*. Deformable regions 33 and 33*a* are attached at the necks. In the embodiment shown, the deformable regions are arc-shaped, and circumscribe and define bounded arc-shaped openings 34 and 34*a*. The deformable regions have outer portions 35 and 35*a*, and inner portions 36 and 36*a* having a smaller radius. On the sides opposite to the necks, the deformable regions are attached to tips 37 and 37*a*. The devices are not limited to any particular dimensions. The length of the central body 31 is chosen according to the desired spacing between eyelets in the fastened articles. The length of the tips 37 and 37*a* can be chosen to be sufficient to provide an adequate grip for the fingers, after the tip has been inserted through an eyelet. The diameter of the tips, and the dimensions of the deformable regions can be determined by the dimensions of the eyelets through which they must pass upon installation, and through which they must not pass when the device is in use and under tension.

It will be appreciated that the arc shape of the deformable region shown in the drawings represents only one of numerous equivalent embodiments. The openings 34 and 34*a* defined by the deformable regions may likewise be of any geometric shape. In embodiments, the inner portions 36 and 36*a* of the deformable regions are so situated as to interfere with the inward deformation of the outer portions 35 and 35*a*, thereby preventing a reduction in cross-section. This function requires only that the inner portions occupy the space into which the outer portions collapse upon application of tension, as described below. It will be appreciated that this is a matter of relative location, and that the invention is not limited to any particular geometric shapes for the inner and outer portions of the deformable region. Thus the inner portion 36 can have a generally convex shape, and the outer portion 35 can have a complimentary, generally concave shape. For example a convex inner portion 36 may have the shape of a wedge, with the concave outer portion 35 having a complimentary V-shape. Portion 36 may take the form of a rectangular block, and portion 35 may feature a complimentary rectangular cavity. Other combinations of shapes will readily occur to those of skill in the art. According to embodiments, the openings 34, 34A can be omitted.

Figure 25:
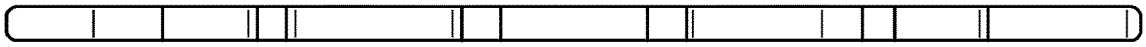
FIG. 25 is a side view of the device shown in FIG. 23.
Figure 26:
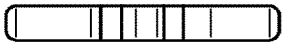
FIG. 26 is an end view of the device shown in FIG. 23.

FIG. 25 is a side view of the device shown in FIG. 23. FIG. 26 is an end view. It will be seen from these views that the cross-section of the tips and central body are substantially rectangular throughout this particular example. It will be appreciated that a round cross-section for the tips may be preferred when dealing with circular eyelets or grommets. The cross section of the central body may be varied for manufacturing convenience, or for cosmetic purposes, within the limits imposed by the desired strength and elasticity of the fastener.

Figure 27:
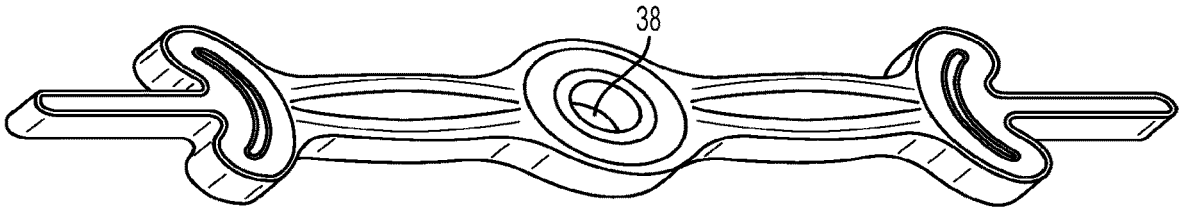
FIG. 27 is a perspective view of an embodiment of the invention.
Figure 28:
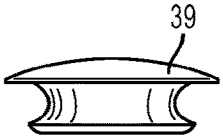
FIG. 28 shows a decorative insert for use with the embodiment of FIG. 27.

FIG. 27 is an alternative embodiment in which the central body bears a hole 38, into which a decorative button 39 (FIG. 28) can be press-fit. Button 39 can be decorated in any manner desired, for example, it can be of a contrasting color or attractive pattern; it can be jeweled; or it can bear a team or school logo. A small battery and LED light(s) can be built into the button if desired.

Figure 29:
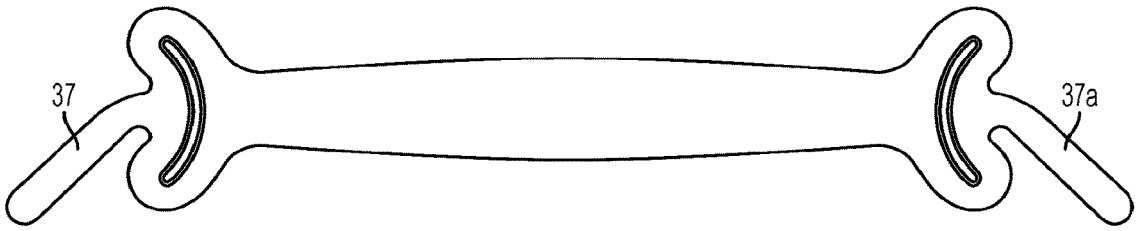
FIG. 29 is a top view of a third embodiment of the invention.

FIG. 29 shows an alternative embodiment wherein the tips 37 and 37*a* are disposed at an angle to the central body of the device. This embodiment may be easier to insert into eyelets in crowded environments, which may lack a clear path for perpendicular entry or exit.

Figure 30:
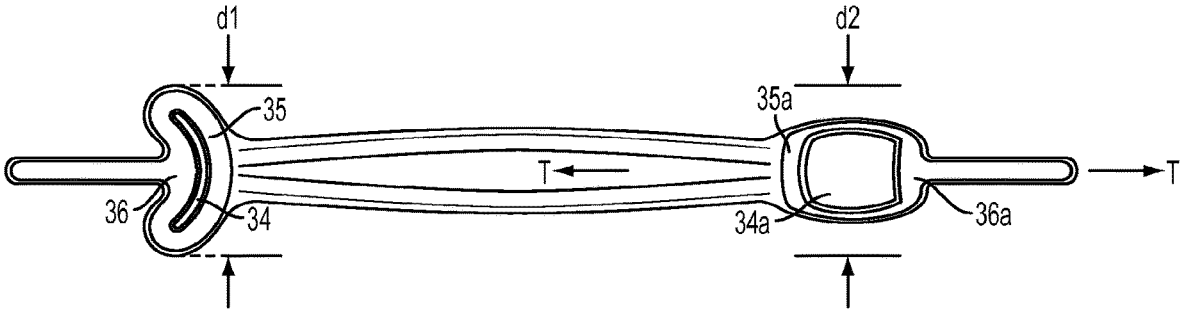
FIG. 30 shows the view of FIG. 24, with one of the deformable regions being stretched by tension "T," resulting in a reduction in diameter from d1 to d2.

FIG. 30 shows the same top view as FIG. 24, but illustrates the deformation of the opening 34*a* upon application of tension T. The tension causes inner portion 36*a* to be pulled away from outer portion 35*a*, and the sides of the opening are free to collapse into the enlarged opening 34*a*. As the deformable region is stretched, it grows narrower, and the width of the deformable region, originally d1, is reduced to d2. With sufficient tension and sufficient stretching, the deformed region can be pulled through an eyelet. Release of the tension allows the deformed region to rebound to its original shape, with the eyelet now trapped around the neck of the device.

Figure 31:
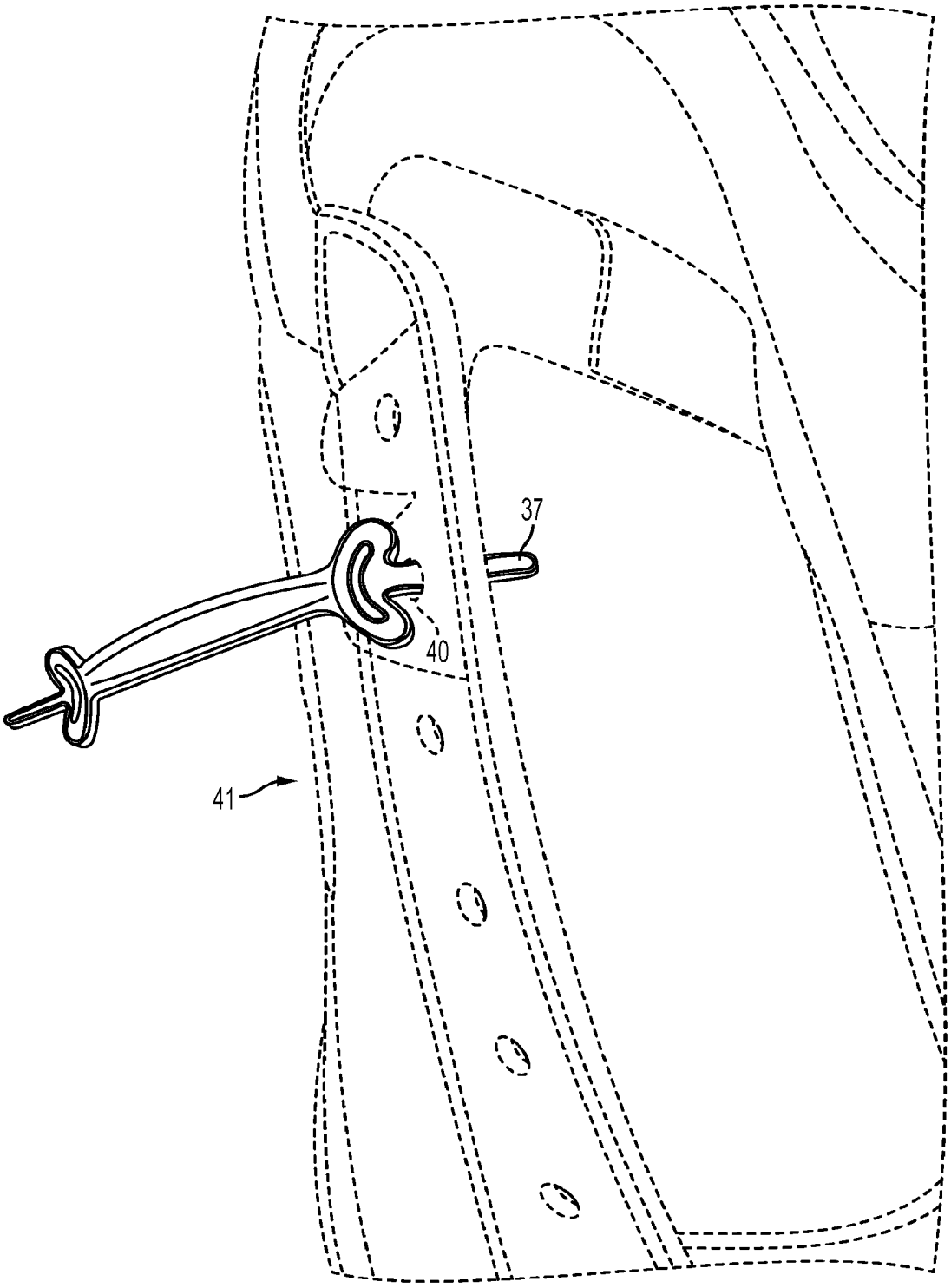
FIG. 31 shows a device according to an embodiment, wherein the first tip is inserted into an eyelet of an athletic shoe.
Figure 32:
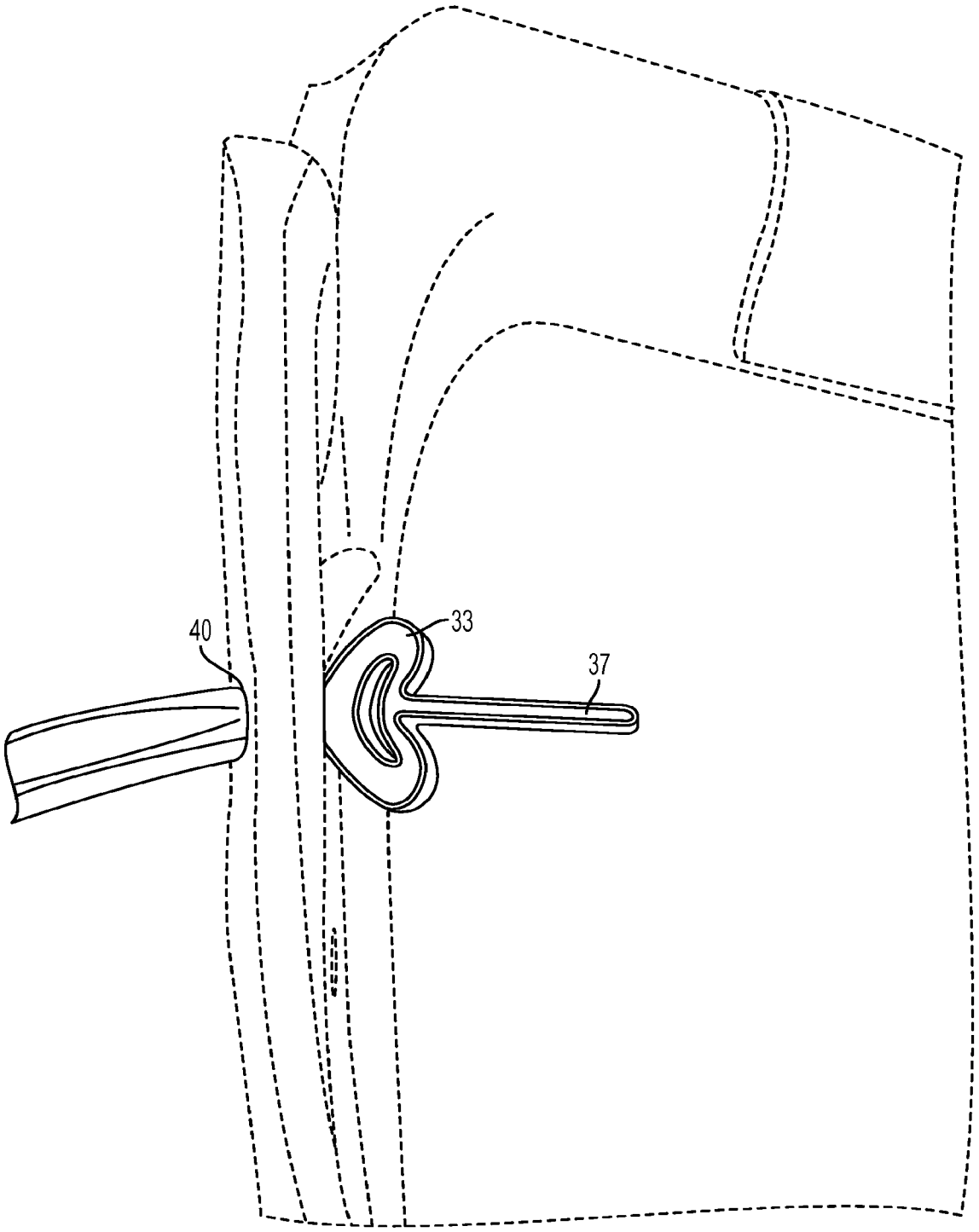
FIG. 32 shows the device of FIG. 31 after the first deformable region has been pulled through the eyelet.
Figure 33:
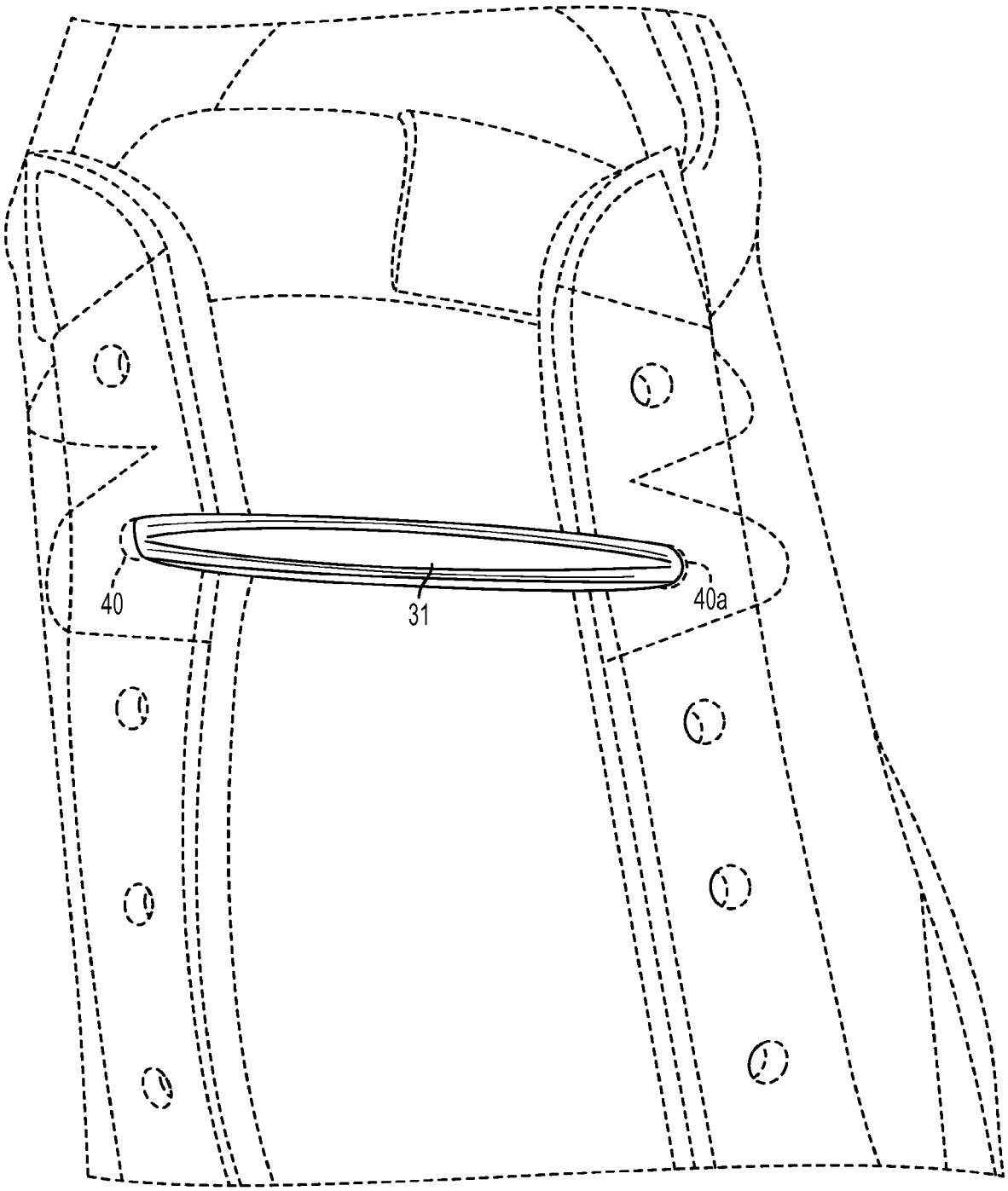
FIG. 33 shows the device of FIG. 32, after being installed by pulling the second deformable region through an eyelet on the opposite side of the shoe.

FIGS. 31-33 show a method of use of a fastener of the invention, to fasten closed an athletic shoe 41. Tip 37 of the device is inserted into eyelet 40 (FIG. 31), and the tip is then pulled until the deformable region 33 has been pulled through the eyelet, leaving the neck of the device within the eyelet 40 as shown in FIG. 32. The tip on the other end of the device can then be inserted into an eyelet 40*a* on the opposite side of the shoe. Next, the deformable region can be again pulled through, and upon release of tension, the device is installed. It will be appreciated that the device can be installed diagonally if the user so desires; this will result in a more tightly fastened shoe.

Having described at least one of the preferred embodiments of the present invention with reference to the accompanying drawings, it will be apparent to those of ordinary skill in the art that the invention is not limited to those precise embodiments, and that various modifications and variations can be made in the presently disclosed system without departing from the scope or spirit of the invention.

Thus, it is intended that the present disclosure cover modifications and variations of this disclosure provided they come within the scope of the appended claims and their equivalents.

What is claimed is:

1. A fastening device for connecting two identified openings, the fastening device comprising:

an elongated main body member defining a longitudinal axis, the main body member having a first portion with a first end portion and a second portion with a second end portion at opposite ends of the longitudinal axis, the first portion being releasably connected to the second portion;

a first tip end portion located at the first end portion of the main body member and a second tip end portion located at the second end portion of the main body member, the first and second tip end portions each having an outer dimension configured to pass through one of the identified openings; and a first neck region disposed in between the main body member and the first tip end portion and a second neck region disposed in between the main body member and the second tip end portion, each of the first neck region and the second neck region having a width that is less than a width of the main body member, wherein in a relaxed state, the first and second tip end portions extend substantially orthogonal to the longitudinal axis, and wherein the first and second tip end portions are each elastically pivotable with respect to the main body member about the longitudinal axis to permit passage of the respective tip end portion through one of the identified openings, wherein the main body member is coplanar with the first tip end portion and the second tip end portion, wherein each of the first portion and the second portion of the main body member comprise at least one engaging region and a toggle system, and wherein the at least one engaging region of one of the first portion and second portion is configured to receive the toggle system of the other of the first portion and second portion.

2. The fastening device according to claim 1, wherein the fastening device is symmetrical about the longitudinal axis.

3. The fastening device according to claim 2, wherein the fastening device has two different axes of symmetry.

4. The fastening device according to claim 1, wherein:

the fastening device is made of an elastic material to allow for flexing in at least two dimensions.

5. The fastening device according to claim 1, wherein:

each of the first and second tip end portions includes a stiffening member located therein.

6. The fastening device according to claim 1, the at least one engaging region comprises at least one opening.

7. The fastening device according to claim 6, wherein the at least one opening is configured to receive the toggle system, and wherein the toggle system comprises a rounded member.

8. The fastening device according to claim 1, wherein the main body member comprises a transverse axis orthogonal to the longitudinal axis, and wherein the first tip end portion is a mirror image of the second tip end portion about the transverse axis.

9. The fastening device according to claim 1, wherein each of the first portion and the second portion of the first tip end portion has a rounded surface and wherein each of the first portion and the second portion of the second tip end portion has a rounded surface.

10. The fastening device according to claim 1, wherein each of the first tip end portion and the second tip end portion has at least one rounded surface.

11. The fastening device of claim 1, wherein each of the first and second tip end portions includes a first portion that extends to one side of the longitudinal axis of the main body member and a second portion that extends to an opposite side of the longitudinal axis of the main body member, wherein each of the first and second tip end portions includes a width extending perpendicular to the longitudinal axis of the main body member and a length extending along the longitudinal axis of the main body member, the width being longer than the length, and wherein the first neck region has a narrowest width between the first tip end portion and the main body member.

12. The fastening device according to claim 11, wherein the width of each of the first tip end portion and the second tip end portion is less than the width of the main body member.

13. The fastening device of claim 1, wherein the at least one engaging region comprises a plurality of engaging regions and the toggle system comprises a toggle neck and a toggle.

14. A method of connecting two identified openings, comprising:

providing a fastening device including an elongated main body member defining a longitudinal axis, and first and second tip end portions located at opposite ends of the longitudinal axis, the first and second tip end portions extending substantially orthogonal to the longitudinal axis;

inserting the first tip end portion through one of the identified openings;

flexing the first tip end portion with respect to the main body member, thereby permitting passage of the first tip end portion through the one of the identified openings;

relaxing the first tip end portion;

inserting the second tip end portion through the other of the identified openings;

flexing the second tip end portion with respect to the main body member, thereby permitting passage of the second tip end portion through the other of the identified openings; and relaxing the second tip end portion;

whereby when the first and second tip end portions are in the relaxed state, they engage the two identified openings with the main body member between the two identified openings, wherein the main body member is coplanar with the first tip end portion and the second tip end portion, wherein the main body member comprises a first portion releasably connected to a second portion, each of the first portion and the second portion of the main body member comprising a at least one engaging region and a toggle system, and wherein the at least one engaging region of one of the first portion and second portion is configured to receive the toggle system of the other of the first portion and second portion.

15. The method of claim 14, wherein the fastening device further includes a second neck region disposed in between the main body member and the second tip end portion, each of the first neck region and the second neck region having a width that is less than a width of the main body member.

16. The method of claim 14, wherein each of the first and second tip end portions includes a first portion that extends to one side of the longitudinal axis of the main body member and a second portion that extends to an opposite side of the longitudinal axis of the main body member.

17. The method of claim 14, wherein the fastening device is symmetrical about the longitudinal axis.

18. The method of claim 14, wherein each of the first and second tip end portions includes a width extending perpendicular to the longitudinal axis of the main body member and a length extending along the longitudinal axis of the main body member, the width being longer than the length, and wherein the width of each of the first tip end portion and the second tip end portion is less than the width of the main body member.

19. The method of claim 14, further comprising pulling at least one of the first tip end portion or the second tip end portion in an outward direction from the respective identified opening to permit passage of the respective tip end portion through one of the identified openings, thereby disconnecting the two identified openings.

* * * * *